US009302263B2

(12) United States Patent
Kuok

(10) Patent No.: US 9,302,263 B2
(45) Date of Patent: Apr. 5, 2016

(54) MICROFLUIDICS APPARATUS AND METHODS

(75) Inventor: Meng-Han Kuok, Oakington (GB)

(73) Assignee: Camtech Management PTD LTD, Singapore (SG)

( * ) Notice: Subject to any disclaimer, the term of this patent is extended or adjusted under 35 U.S.C. 154(b) by 594 days.

(21) Appl. No.: 13/516,442

(22) PCT Filed: Dec. 13, 2010

(86) PCT No.: PCT/GB2010/052074

§ 371 (c)(1),
(2), (4) Date: Jul. 20, 2012

(87) PCT Pub. No.: WO2011/073643

PCT Pub. Date: Jun. 23, 2011

(65) Prior Publication Data

US 2012/0276550 A1 Nov. 1, 2012

(30) Foreign Application Priority Data

Dec. 15, 2009 (GB) ..... 921840.5

(51) Int. Cl.
*B01L 3/00* (2006.01)

(52) U.S. Cl.
CPC ... *B01L 3/502761* (2013.01); *B01L 2200/0647* (2013.01); *B01L 2300/0645* (2013.01); *B01L 2300/0663* (2013.01); *B01L 2400/0424* (2013.01)

(58) Field of Classification Search
CPC ..... B10L 2400/0424; B01L 3/502761
See application file for complete search history.

(56) References Cited

U.S. PATENT DOCUMENTS 6,673,225 B1 * 1/2004 Arnold ..... 204/547
2002/0139674 A1 10/2002 Mariella (Continued)

FOREIGN PATENT DOCUMENTS

WO WO 2007/107910 A1 9/2007
WO WO 2009/112537 A1 9/2009

OTHER PUBLICATIONS

International Search Report for corresponding PCT/GB2010/052074, Completed Jan. 28, 2011 by Barnaby Hoyal of the EPO.

(Continued)

*Primary Examiner* — Melanie Y Brown
(74) *Attorney, Agent, or Firm* — Tarolli, Sundheim, Covell & Tummino LLP

(57) ABSTRACT

This invention relates to microfluidics apparatus and methods for particle concentration in sensors for sensing biological entities such as cells, spores and the like. We describe a microfluidic sensor for sensing biological particles including a particle concentration device for performing concentration of particles in three dimensions. The sensor device comprises a substrate bearing a microfluidic channel or chamber for carrying a conductive fluid bearing the particles. The channel has: first and second electrodes spaced apart on the channel or chamber for defining an electric field therebetween, and a sensing surface on an inner surface of the channel or chamber. The particle concentration device comprises means for applying an ac voltage across the electrodes to perform simultaneously: i) electrohydrodynamic generation of a convection current flow in the fluid; and ii) 3D concentration of the particles in said fluid by dielectrophoretic attraction or repulsion of the particles towards or away from a region of increased electric field, to increase a concentration of the particles at sensing surface of said sensor.

9 Claims, 4 Drawing Sheets

(56) References Cited

U.S. PATENT DOCUMENTS

| | | | | |
|---|---|---|---|---|
| 2003/0047456 | A1 | 3/2003 | Medoro | |
| 2004/0011650 | A1* | 1/2004 | Zenhausern | B01L 3/502746 204/547 |
| 2005/0014146 | A1* | 1/2005 | Manaresi et al. | 435/6 |
| 2005/0112548 | A1* | 5/2005 | Segawa | B01L 3/502715 435/4 |
| 2007/0125941 | A1* | 6/2007 | Lee | B01L 3/502761 250/251 |
| 2009/0017469 | A1* | 1/2009 | Lowe et al. | 435/7.9 |
| 2009/0061076 | A1* | 3/2009 | Rosicke et al. | 427/66 |
| 2013/0146459 | A1* | 6/2013 | Bazant | B01F 13/0071 204/454 |

OTHER PUBLICATIONS

Yang, et al.: "*Electrical/electrochemical Impedance for Rapid Detection of Foodborne Pathogenic Bacteria*"; Biotechnology Advances, Elsevier Publishing, Barking, GB, vol. 26, No. 2, Nov. 12, 2001, pp. 135-150, XP022426821, ISSN: 0734-9750, DOI:10.1016/J.BIOTECHADV.2007.10.003 p. 142, col. 2, paragraph 1, section 3.4.

* cited by examiner i)

ii)

MICROFLUIDICS APPARATUS AND METHODS

RELATED APPLICATIONS

The present application is a U.S. 371 patent application of PCT/GB2010/052074, filed Dec. 13, 2010, which is incorporated herein its entirety.

FIELD OF THE INVENTION

This invention relates to microfluidics apparatus and methods for particle concentration in particular for sensor applications for sensing biological entities such as cells, spores and the like.

BACKGROUND TO THE INVENTION

There is a continuing need for improvements to microfluidic devices, in particular for biological so-called lab-on-chip applications. Such a device may comprise, for example, a section for generating biological material to be analysed, a section for manipulating the biological material, and a sensing section to sense the results, all integrated within a single device. Here we are particularly concerned with sensing biological particles such as spores, cells and similar entities. Various prior art sensing techniques are known including that described in U.S. Pat. No. 6,352,838, in which a dielectrophoretic force is employed to selectively separate a target material from a contaminant material; and that described in US2007/0175755 (which employs a fluid flow generally aligned with a longitudinal axis of a fluid containing cell). Further background prior art can be found in: US 2004/163955; U.S. Pat. No. 5,858,192; WO2004/059290; US2002/088712; US2007/175755; and GB2266153A.

SUMMARY OF THE INVENTION

According to a first aspect of the invention there is therefore provided a microfluidic sensor for sensing biological particles including a particle concentration device for performing concentration of particles in three dimensions, the sensor device comprising: a substrate bearing a microfluidic channel or chamber for carrying a conductive fluid bearing said particles for concentration, wherein said channel has: first and second electrodes spaced apart on said channel or chamber for defining an electric field therebetween; and a sensing surface on an inner surface of said channel or chamber for contact with said fluid to selectively sense said particles; and wherein said particle concentration device comprises means for applying an ac voltage across said electrodes to flow said particles past said sensing surface and to concentrate said particles in three dimensions adjacent to or away from said sensing surface.

In some preferred embodiments of the apparatus the sensing circuit is either adjacent to or opposite an electrode. For example in one arrangement a pair of electrodes is located on one side of the microfluidic channel or chamber and the sensing surface is located on the opposite side of the channel or chamber so that convective circulation may be driven by the AC voltage to sweep the particles past the sensing surface. Where the electrodes are located on the same side of the channel or chamber a gap between the electrodes may be approximately the same as the distance from the side of the channel or chamber bearing electrodes to the opposite side of the channel or chamber bearing the sensing surface (+/− about 50% tolerance). In such an arrangement the width of an electrode may also be approximately the same as this distance (again to within approximately +/−50%). In plan view the electrodes may define a plurality of configurations according to the application, for example a serpentine or interdigitated electrode array.

Thus in embodiments the particles are concentrated in a 3D region, in orthogonal x-, y-, and z- directions, adjacent the sensing surface, to facilitate sensing. This is achieved by a circulating/convective flow of fluid resulting from an electrohydrodynamic effect caused by the electrode array in combination with an opposing dielectrophoretic force resulting from an induced polarisation of the particles.

In embodiments the particles have a mean maximum dimension of at least 0.5 μm, more particularly a mean maximum dimension in a range 0.5 μm to 200 μm. Thus in embodiments the particles comprise relatively large entities such as cells or spores. In other embodiments a particle may comprise a droplet of oil in an aqueous fluid (emulsion), the droplet of oil comprising a biological entity. Broadly speaking the microfluidic channel dimensions and electrodimensions may be chosen in proportion to the size of the particles and may, in embodiments be of order 10 μm-500 μm, for example around 50-100 μm.

In preferred embodiments the particle concentration device concentrates particles adjacent the sensing surface but, as described in more detail below, particles may also be concentrated away from the sensing surface if these, in effect, are a distractor from a target to be sensed.

Any of a range of different sensing surfaces may be employed, including but not limited to, a polymer membrane (which includes, in embodiments, a hologram) a plasmon-based sensor, a surface acoustic wave-based sensor and other types of sensor with which the skilled person will be familiar. Examples of holographic polymer sensors are described, for example, in: WO2004/081624. In embodiments an antibody-antigen reaction is employed to selectively bind the target, but other selective sensing mechanisms may alternatively be employed including, for example, a selective chemical reaction/bond, and selective binding of complimentary DNA strands; against the skilled person will be aware of many other techniques which may be employed.

In some preferred embodiments of the device the means for applying the AC voltage comprises means to apply a voltage at a frequency of greater than 100 KHz, preferably greater than 1 MHz. As described further below, in embodiments the driving frequency is chosen (in conjunction with the conductivity of the fluid) such that particles experience a dielectrophoretic (DEP) force arising from induced polarisation of a particle in the electric field, as well as convective flow arising from an electrohydrodynamic (EHD) force, broadly speaking an electrothermal force on a double layer adjacent an electrode which results in a convective flow of the fluid. In embodiments use of an AC voltage, though not essential, reduces the risk of bubble generation due to excessive heating, and peeling off of the thermal layer.

In embodiments the conductive fluid comprises water including a salt or buffer, for example potassium chloride, and is thus sufficiently conductive for the EHD effect to induce a convective flow. The presence of the DEP effect and whether this is attractive (attracting a particle towards a high electric field region) or repulsive depends upon a combination of the conductivity of the fluid and the frequency of the applied AC voltage: at higher electrical conductivities (for example greater than 20-30 mS/m) a high frequency may be repulsive and a low frequency attractive whereas at lower conductivities (for example less than 20 mS/m) a low AC frequency may be repulsive and a high frequency attractive. (In embodiments the fluid has a conductivity of greater than 1 mS/m or preferably greater than 10 mS/m). Depending upon the physical configuration of the device particles may either be pushed away from or drawn towards the electrodes, more particularly an edge or corner of an electrode (where the field is highest), and this may be used to draw particles away from or encourage particles towards a sensing surface. In some particularly preferred embodiments the particles are concentrated near the electrodes by selecting the AC voltage which provides an attractive force and then swept towards the sensing surface by a convective flow generated by EHD, so that a combination of both DEP and EHD is employed to perform particle concentration in three dimensions. In embodiments the AC voltage applied may be of order 10V.

In the context of this specification the reference to three dimensional concentration refers to concentration in the Z-dimension or thickness of a microfluidic device, for example in a lab-on-a-chip, that is in a third dimension rather than in a lateral plane (or rather than only in a lateral plane). Thus in embodiments the substrate defines a lateral plane and the particle concentration device is configured to concentrate said particles in a direction perpendicular to said lateral plane. More particularly in embodiments the channel or chamber has upper and lower surfaces spaced apart in said direction perpendicular to said lateral plane, said upper surface being further from said substrate than said lower surface, and one or both of said electrodes is disposed on or adjacent said upper surface.

In a related aspect the invention provides a method of using 3D particle concentration for particle sensing in a microfluidic device including a conductive fluid bearing said particles, the method comprising: applying an ac voltage across a pair of electrodes in channel or chamber of said microfluidic device including a conductive fluid bearing said particles to perform, simultaneously: i) electrohydrodynamic generation of a convection current flow in said fluid; and ii) 3D concentration of said particles in said fluid by dielectrophoretic attraction or repulsion of said particles to or from a region of increased electric field generated by said ac voltage across said electrodes; and wherein said convection current flow and 3D concentration increase a concentration of said particles towards a sensing surface of said sensor.

In a still further aspect the invention provides a system for using 3D particle concentration for particle sensing in a microfluidic device including a conductive fluid bearing said particles, the system comprising: means for applying an ac voltage across a pair of electrodes in channel or chamber of said microfluidic device including a conductive fluid bearing said particles to perform, simultaneously: i) electrohydrodynamic generation of a convection current flow in said fluid; and ii) 3D concentration of said particles in said fluid by dielectrophoretic attraction or repulsion of said particles to or from a region of increased electric field generated by said ac voltage across said electrodes; and wherein said convection current flow and 3D concentration increase a concentration of said particles towards a sensing surface of said sensor.

In still further embodiments of the above described techniques the sensing surface comprises a sensing surface with an optically detectable sensing reaction, for example a sensing hologram, and the sensing surface is provided over one of the electrodes and the electrode is arranged to be substantially transparent. For example >5%, 10%, 50% or 80% transmissive a sensing wavelength in the range of 300 nm to 1900 nm, more particularly 400 nm to 1600 nm. In this way the sensing surface is in contact with the fluid in the device but still visible through the electrode (and wall of the channel/chamber) and thus may be optically interrogated from outside the microfluidic device, for example by means of a laser, light emitting diode or other light source. The transparent electrodes may comprise a suitably thin layer of metal, or ITO (Indium Tin Oxide) or a similar material.

Thus in a further aspect there is a microfluidic sensor for sensing biological particles including a particle concentration device for performing concentration of particles in three dimensions, the sensor device comprising: a substrate bearing a microfluidic channel or chamber for carrying a conductive fluid bearing said particles for concentration, wherein said channel has: first and second electrodes spaced apart on said channel or chamber for defining an electric field therebetween; and a sensing surface on an inner surface of said channel or chamber for contact with said fluid to selectively sense said particles; and wherein said particle concentration device comprises means for applying an ac voltage across said electrodes to flow said particles past said sensing surface and to concentrate said particles in three dimensions adjacent to or away from said sensing surface; and wherein said sensing surface is configured to provide an optically detectable sensing reaction, wherein said sensing surface is provided over one of said electrodes, and wherein said one of said electrodes is substantially transparent.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Design of Spore Concentration, Capture and Detection Chamber

The main component of such a lab-on-chip device is the chamber in which DEP concentration, followed by antibody capture and then holographic detection is carried out. We carry out spore concentration using a combination of electrohydrodynamic (EHD) effects and DEP forces. A design to accommodate the two principles is embodied within the device shown schematically in FIG. 1*a*.

Figure 1A:
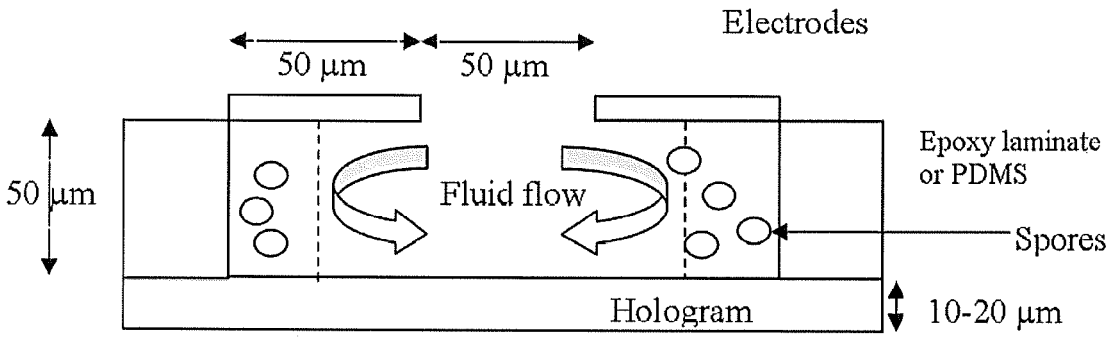
FIG. 1*a* shows a side view of an example of a sensor in combination with a spore concentration chamber, according to an embodiment of an aspect of the invention, more particularly a side view of a spore concentration chamber design, with height 50 μm, on top of hologram, (hologram thickness varies between 10-20 μm)

FIG. 1*a* shows the spore concentration chamber which integrates the electrodes and the hologram. The resulting flow of fluid due to the EHD effect from the electrode array is circular, and the diameter of the circular rotation is on the same scale as the electrode dimensions (50 μm). The layout of electrodes was considered as either an interdigitated array or a castellated array.

The spores in suspension are pushed down towards the hologram surface by a combination of negative DEP and EHD effects. Negative DEP acts to repel spores from the top electrodes, while the electroosmostic force acts to create a circular current of spores within the liquid volume and deposits the spores in the area corresponding to the middle of the electrodes—shown by the dotted lines in FIG. 1*a*. This circular flow arises due to the presence of an electrothermal gradient in the liquid adjacent to the electrodes. At the same time, the gravity effect will also result in spores drifting downwards towards the hologram surface. An alternative layout in which the hologram is fabricated on top of the electrode surface and spores are pulled down by positive DEP was also considered. However the combination of electrodes with the polymer hydrogel would give rise to some complications. The holographic signal would not be as visible, if a gold electrode is used, and the charge on the electrode may have an effect on the swelling or contraction of the hologram.

A layer of SU8 epoxy laminate in between the electrodes and hologram is used to define the chamber height to 50 μm. It also seals the spore concentration chamber and prevents rapid drying of the spore suspension.

Alternative configurations are the construction of the hologram on conductive indium tin oxide (ITO) or gold coated glass slides, or the construction of a hologram on a conductive gold ring fabricated on glass. Holograms were successfully fabricated onto a standard sized ITO coated glass slide, and a 6 mm diameter hologram was fabricated on top of a gold ring electrode. However, peeling off of the hydrogel occurred during the application of positive or negative charge to the ITO surface or gold electrodes (even with the use of thiolated gold), or after an extended period of time (~1 month) as adhesion was not as robust as on the glass surface. In addition, the exposure of the hologram was difficult because of the reflectivity of gold.

High frequency (~20 MHz) and conductivity (>12.5 mS/m))were used to facilitate a large negative DEP force. The dimensions of electrodes were chosen as the DEP and EHD effects occur on the length-scale of the electrodes. The electrodes were also chosen to be within 1 order of magnitude of the size of the spores.

Figure 1B:
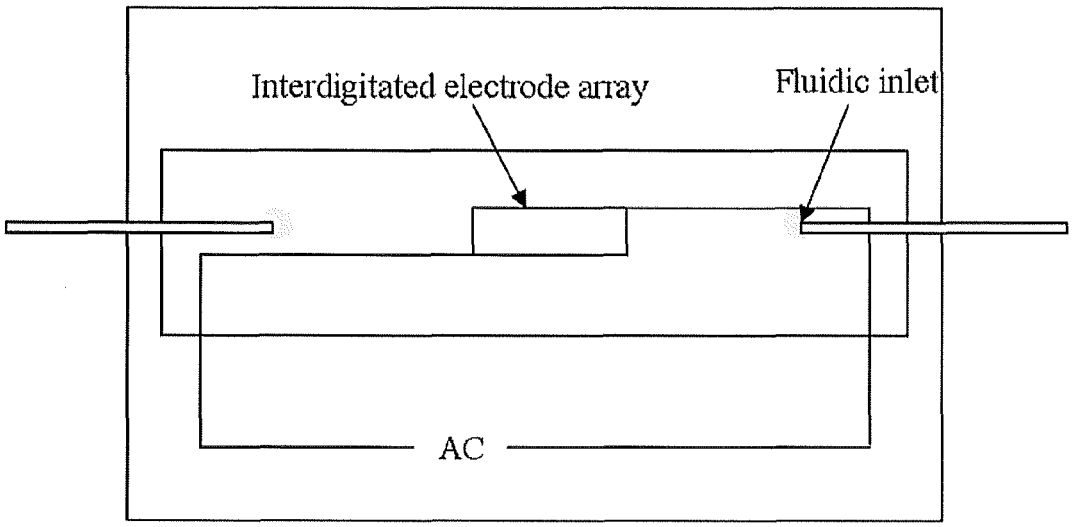
FIG. 1*b* shows a more detailed example of the FIG. 1*a* device.
Figure 1B:
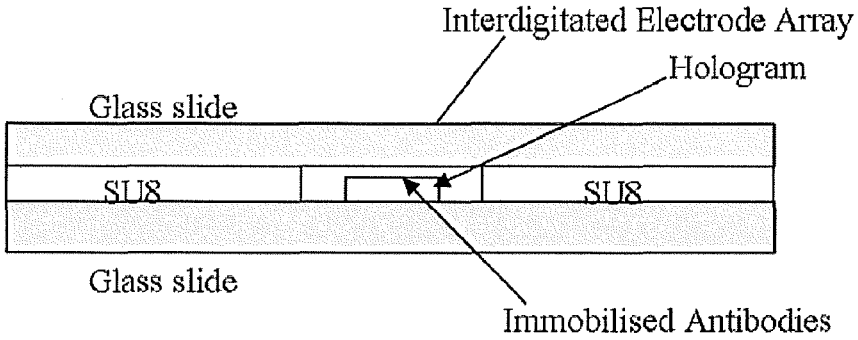

FIG. 1*b* shows i) a top view and ii) a side view of a 3 layer fluidic device, with an interdigitated electrode array connected to AC supply. 100 nm thick platinum electrodes were fabricated onto glass slide via a 10 nm thick titanium adhesion layer to form interdigitated electrode array with 40 μm electrode separation.

Figure 2:
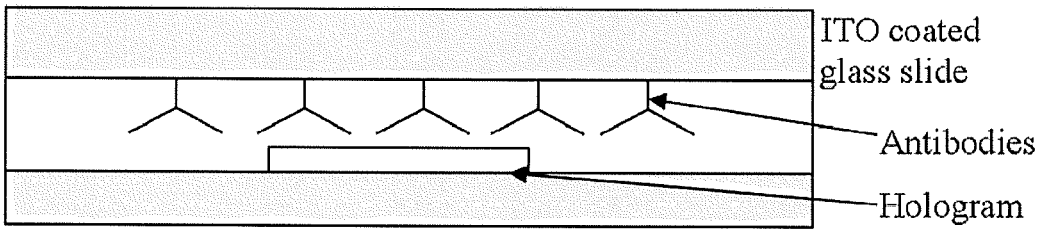
FIG. 2 shows a layout of antibody immobilisation within a capture and detection chamber.

Following spore concentration, antibody capture of spores would take place on the surface of the hologram. FIG. 2 shows a layout for antibody immobilisation to take place.

Antibodies may be immobilised in between electrodes, on electrodes (in the case of ITO electrodes) or onto the polymer hydrogel surface of the hologram. Antibody capture could be carried out concurrently with the application of electric charge, or during an incubation period after the application of charge. As shown in FIG. 1*a*, spores may be deposited in the area corresponding to the middle of the electrodes. Hence, it would potentially achieve the highest capture yield to carry out antibody capture in this area. Following antibody capture, spore germination would be initiated and holographic detection takes place.

Device Assembly and Packaging

The proposed design is for the construction of a three layer fluidic device:

The first layer consists of a 6 mm diameter poly{HEMA-coEDMA(6 mol %)-co-MAA(5 mol %)} hologram fabricated on a glass slide.

A second PDMS layer with an area cut out to the shape of a parallelogram and height of 50 μm is used to form the concentration chamber (allowing sufficient height for the hologram thickness). Alternatively, a photoresist epoxy SU8 (MicroChem Corp, Newton, Mass.) is fabricated on the lower slide containing the hologram to a height of 50 μm (fabrication by spin coating followed by heating at 200° C. for 30 min for adhesion to glass to take place).

The third layer consists of a glass slide or epoxy layer on which the castellated electrode array is patterned out of either platinum or indium tin oxide electrodes.

The three layer assembly is then either held in place by pressure using a clamp, or glued on permanently with epoxy adhesive.

Figure 3:
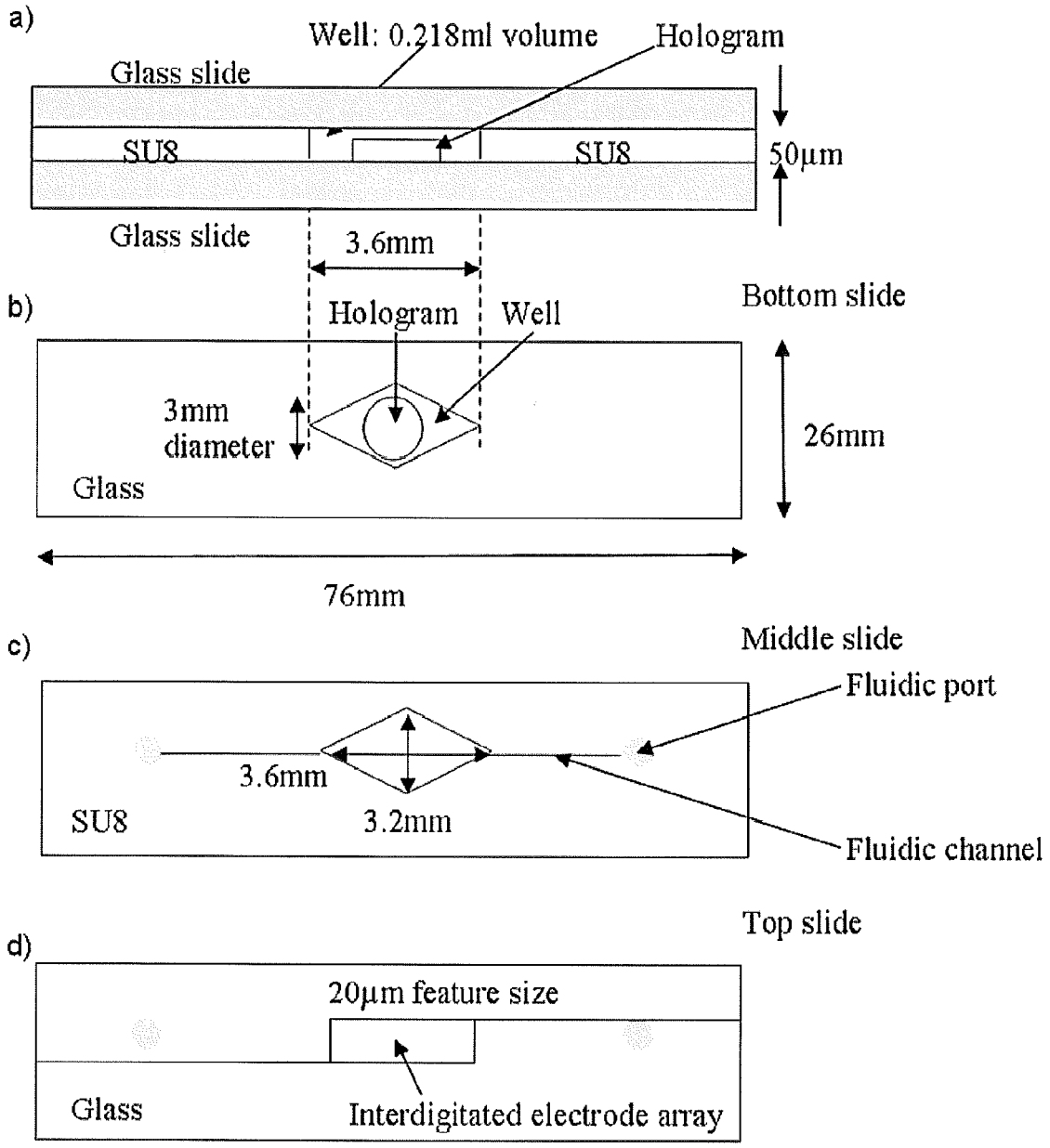
FIG. 3 shows a design of the fluidic capture-culture device showing (a) cross-section; (b) top view of bottom layer of fluidic device; (c) top view of middle layer of fluidic device with cutout section; (d) top view of top layer of fluidic device with electrode array, (diagram not to scale)

The total cavity volume is calculated to be 0.218 ml, (assuming that the hologram volume within the cavity is 0.07 ml based on a hologram thickness of 10 μm). Sample and germination wash would be introduced to the fluid cavity by means of the fluidic port. However, the liquid would be static during the operation of the device with antibody capture and holographic detection. The design layout of the fluidic device is shown in FIG. 3: FIG. 3 shows a design of the fluidic capture-culture device (a) cross-section; (b) top view of bottom layer of fluidic device; (c) top view of middle layer of fluidic device with cutout section; (d) top view of top layer of fluidic device with electrode array, (diagram not to scale).

This design incorporates dielectrophoresis as well as antibody capture in a single device. Antibody capture is not necessary for spore cell concentration, however it may be useful for integration with holograms, as spores can then be captured directly on the hologram surface for increased sensitivity of detection. It would also add another layer of specificity.

A simplified model of the final system has been used in which capture and germination is carried out without any fluid flow, with a starting volume in the μl range.

Characterisation of Dielectrophoretic (DEP) Behaviour of *B. megaterium* QMB 1551 Spores Although the dielectric properties of cells such as yeast have been well characterised, the dielectrophoretic properties of spores have not been characterised. Hence it was desirable to carry out characterisation of *B. megaterium* QMB 1551 spores prior to dielectrophoretic capture. This was done by visually monitoring the response of *B. megaterium* QMB 1551 spores to changes in the frequency of the applied electric field.

Figure 4:
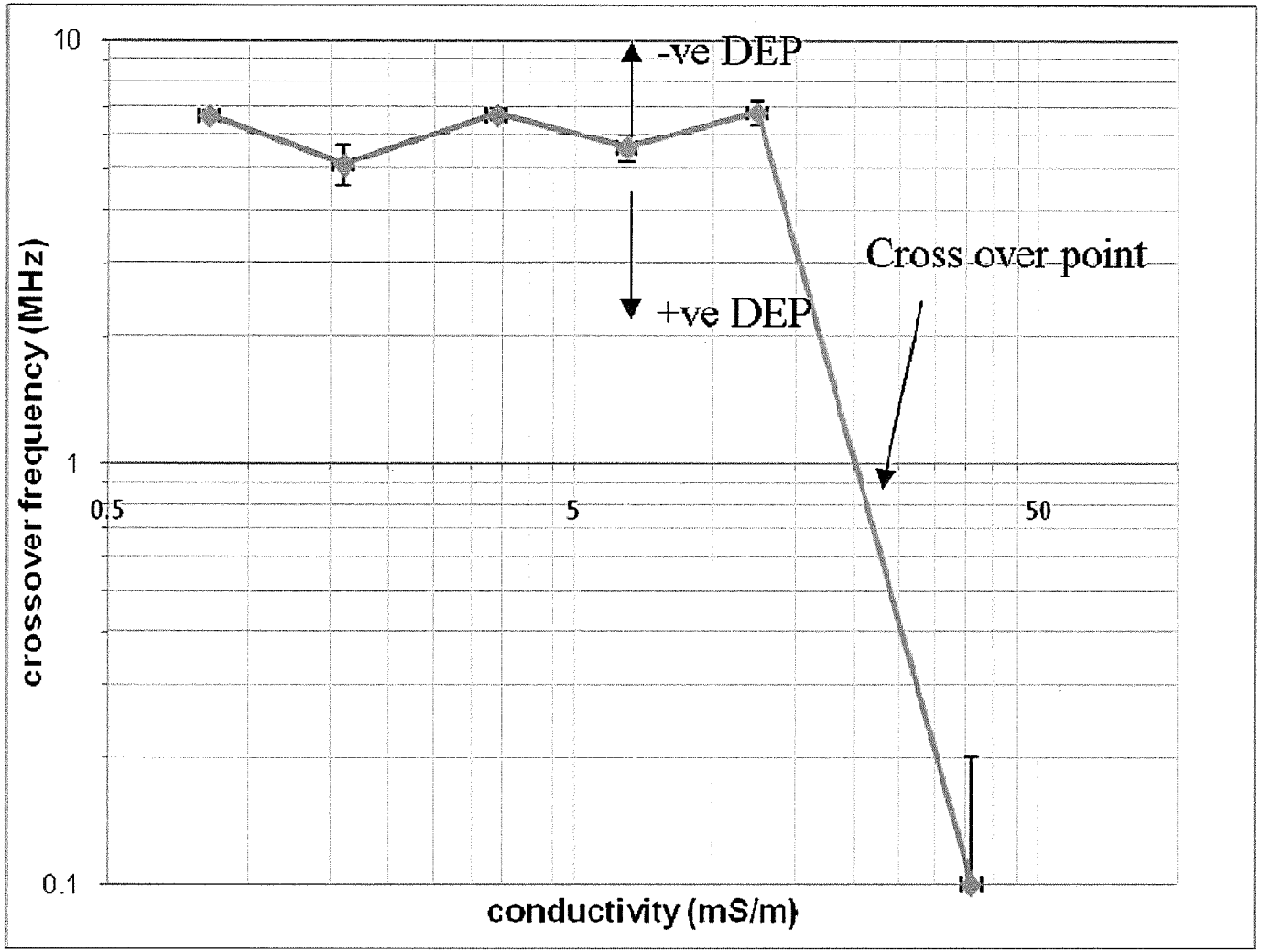
FIG. 4 shows a graph of cross-over frequency against fluid conductivity for DEP attraction/repulsion from a high field region, more particularly a measurement of crossover frequency of *B megaterium* QM B1551 spores. (AC voltage was applied to castellated electrodes; where error bars are not visible they lie within the data point).

FIG. 4 shows the measurement of crossover frequency (at which DEP force=0) at each conductivity value corresponding to the frequency at which the DEP force is zero—negative DEP occurs at frequencies above the plotted line, while positive DEP occurs at frequencies below the plotted line.

In the DEP Force Equation $$F_{DEP}=2\pi R^3\epsilon_m\{Re[K(w)]\}\Delta E^2$$

Where E is the electric field, R is the particle radius, $\epsilon_m$ is the absolute dielectric permittivity of the fluid, and K(w) is the Clausius-Mossotti function (broadly, the polarisability of the particle relative of the fluid as a funcrtion of frequency, w).

Positive DEP occurs when the real part of the Clausius-Mossotti function Re[K(w)]>0 and negative DEP occurs when Re[K(w)]<0.

The crossover frequency values will depend on the medium conductivity and dielectric properties of the spores. The values at higher conductivities are more approximate because of turbulence caused by the fluid motion. There is a constant crossover frequency value until 12.4 mS/m at which point the crossover frequency reduces sharply.

The dielectrophoretic behaviour of the spore cells corresponded to that predicted theoretically for a dielectric with one shell. The graph shape is also similar to that obtained for the dielectrophoretic behaviour of yeast cells.

The crossover frequency between positive and negative DEP using a 0.5 mM buffer was found to be 5.6 MHz according to the graph in FIG. 4.

The basic concentration pattern of spores has particles attracted to electric field intensity maxima and repelled from field intensity minima. For negative DEP, spores collected in a triangular shape in the bays between electrode fingers, while for positive DEP spores accumulated along the field lines in regions of high electrical field strength, at the tips of electrodes.

Importantly, the spores are not seen to germinate either as a result of the application of electrostatic charges during the course of the experiment (10 min) or during the following 20 min, which alleviates such concerns. Given the almost instantaneous (<1 s) alignment of spores in the DEP concentration patterns seen, this approach would be more rapid than the antibody capture and electric field methods. However, upon removal of the AC frequency, the spores return to their normal distribution within the electrolyte solution. Thus, the castellated electrode array could be fabricated on glass and combined with immobilised antibodies. Hence, spore concentration by DEP would take place initially, followed by antibody capture of the spores in close proximity to the immobilised antibody layer. For a continual increase of spore concentration to take place, repeated cycles of AC dielectrophoretic concentration could be used in conjunction with antibody capture. The flowing away of untrapped cells in solution is often the rate-limiting step during DEP cell concentration; hence the use of antibody capture would be desirable to allow accumulation.

Applications of embodiments of the invention include, but are not limited to for detection of spore germination, for example using a combination of antibody capture, in-situ germination and holographic detection. Immobilised antibodies for capture, electrodes for dielectrophoretic (DEP) manipulation of spores, polymer holograms and fluidic channels may be integrated within a single device.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A microfluidic sensor for sensing biological particles including a particle concentration device for performing concentration of particles in three dimensions, the sensor device comprising:

a substrate which defines a lateral plane of said sensor, said substrate bearing a microfluidic channel or chamber for carrying a conductive fluid bearing said biological particles for concentration, wherein said channel has:

upper and lower surfaces spaced apart in said direction perpendicular to said lateral plane, said upper surface being further from said substrate than said lower surface, and first and second electrodes spaced apart on said channel or chamber for defining an electric field therebetween; and a sensing surface on an inner surface of said channel or chamber for contact with said fluid to selectively sense said biological particles;

wherein said particle concentration device comprises a system to apply an ac voltage across said electrodes to perform simultaneously:

i) electrohydrodynamic generation of a convection current flow in said fluid; and ii) three-dimensional (3D) concentration of said particles in said fluid by dielectrophoretic attraction or repulsion of said biological particles to or from a region of increased electric field generated by said ac voltage across said electrodes;

such that said convection current flow and said 3D concentration increase a concentration of said biological particles towards said sensing surface of said sensor, wherein:

one or both of said electrodes is disposed on said upper surface, said sensing surface is opposite said electrode, and said biological particles circulate past said sensing surface and concentrate in three dimensions in a direction perpendicular to said lateral plane adjacent to said sensing surface.

2. A microfluidic sensor as claimed in claim 1 wherein said electrodes are disposed on the same side of said channel or chamber and wherein a gap between said electrodes is the same as a distance from a said electrode to said sensing surface, to within 50% of said distance from a said electrode to said sensing surface.

3. A microfluidic sensor as claimed in claim 1 wherein said particles have a mean maximum dimension in the range of 0.5 to 200 μm.

4. A microfluidic sensor as claimed in claim 3 wherein said fluid is an aqueous fluid and wherein a said particle comprises a droplet of oil in said aqueous fluid, said droplet of oil including a biological entity.

5. A microfluidic sensor as claimed in claim 1 wherein said sensing surface comprises a polymer sensing surface configured to provide an antibody/antigen-based surface sensing reaction.

6. A microfluidic sensor as claimed in claim 1 wherein said means for applying said ac voltage comprises means to apply a said voltage at a frequency of greater than 1 MHz.

7. A microfluidic sensor as claimed in claim 1 wherein said sensing surface is configured to provide an optically detectable sensing reaction, wherein said sensing surface is provided over one of said electrodes, and wherein said one of said electrodes is substantially transparent.

8. A microfluidic sensor as claimed in claim 1 wherein said sensing surface comprises a hologram.

9. A microfluidic sensor as claimed in claim 1, wherein said sensor device is configured to apply repeated cycles of said electrohydrodynamic generation of a convection current flow in said fluid; and said 3D concentration of said particles; and wherein said sensing surface is configured to capture and accumulate said biological particles.

* * * * *